United States Patent [19]

Loomer et al.

[11] Patent Number: 4,697,977

[45] Date of Patent: Oct. 6, 1987

[54] SAFETY BRAKE FOR VERTICAL LIFT

[75] Inventors: Weston R. Loomer, Florence; Randall P. Coons, Crescent Springs, both of Ky.

[73] Assignee: Litton Systems, Inc.

[21] Appl. No.: 926,809

[22] Filed: Oct. 30, 1986

Related U.S. Application Data

[63] Continuation of Ser. No. 504,417, Jun. 15, 1983, abandoned.

[51] Int. Cl.[4] ..... B66B 5/20

[52] U.S. Cl. ..... 414/662; 187/85; 414/282

[58] Field of Search ..... 187/83, 85, 86; 414/282, 674, 662

[56] References Cited

U.S. PATENT DOCUMENTS

| | | | |
|---|---|---|---|
| 242,746 | 6/1881 | Brown | 187/85 |
| 591,189 | 10/1897 | Lotz | 187/85 |
| 710,038 | 9/1902 | Burgart | 187/85 |
| 956,707 | 5/1910 | Hyde | 187/85 |
| 1,510,411 | 9/1924 | Moilanen | 187/86 |
| 1,613,215 | 1/1927 | Albersheim et al. | 187/83 X |
| 1,696,557 | 12/1928 | Tomlin | 187/85 |
| 1,773,869 | 8/1930 | Schank et al. | 187/85 X |
| 1,813,595 | 7/1931 | Abbe | 187/85 X |
| 1,834,652 | 12/1931 | Schmid | 187/83 X |
| 2,581,297 | 1/1952 | Rissler | 187/83 |
| 3,232,381 | 2/1966 | Merson | 187/83 |
| 3,606,039 | 9/1971 | Weston et al. | 414/564 X |
| 3,661,280 | 5/1972 | Atwater | 414/282 |

*Primary Examiner*—Robert J. Spar
*Assistant Examiner*—Stuart J. Millman
*Attorney, Agent, or Firm*—Morris I. Pollack

[57] ABSTRACT

A stacker-retriever lift carriage is disposed to be raised, lowered and positioned, in selected positions with respect to a pair of spaced support masts, by a flexible wire cable one end of which is connected to a lift carriage drive and the other end of which is connected to the lift carriage through a pair of four bar linkages pivotally connected together in spaced parallel relationship to form a safety brake operating mechanism. The upward pull by the cable upon the brake operating mechanism retracts a pair of opposed brake arms, pivotally carried by the brake operating mechanism, to a brake deactivated position with the back ends of each brake arm abutting each other. Loss of the pull of the cable on the lift carriage, as would occur if the cable severed or if the lift carriage hung up, permits a spring housed between the brake arms to move the brake operating mechanism and the brake arms to a braking position with brake pads carried by the brake arms in friction engagement with the support masts.

21 Claims, 6 Drawing Figures

SAFETY BRAKE FOR VERTICAL LIFT

This is a continuation of co-pending application Ser. No. 504,417 filed on 06/15/83, now abandoned.

BACKGROUND OF THE INVENTION

1. Field of Application

This invention relates to safety brake mechanisms for vertical lifts; and more particularly, to safety brake mechanisms for cable hoist type vertical lifts.

2. Description of the Prior Art

Vertical lifts include all types of devices for moving between various levels along a vertical path. Freight elevators, people elevators, and the lifting carriages of stacker cranes and stacker-retriever type devices are merely examples of such equipment.

A considerable number of available vertical lifts are moved from one level to another by a power driven winch or hoist which utilizes a flexible member to raise, lower, and maintain the position of the lift. The flexible member, which can be a chain, cable or the like, extends between the power drive and the lifting platform; and in many instances the combination of drive and flexible member not only function to move the lift between its various levels, but are the only means to keep the lift so positioned. In such lifts, the lifting cage or platform is, in essence, hanging in space from the flexible member while the lift is being raised or is in raised positions above the ground level. Should the chain or cable, or their connecting members or drives, on such vertical lifts fail, then the lifting platform will plummet or free-fall to the ground level. People can be hurt or killed, and materials being carried may be damaged or destroyed.

Some available vertical lifts incorporate free-fall prevention devices, or brakes, to arrest or slow down what would otherwise be an unrestricted dropping of the vertical lift should a failure occur. However, those lifts which merely rely upon counterweighting to prevent free-fall may be found lacking since fixed-weight counterweights can prove to be ineffective for the job if the load weight is inadvertently increased, or will consume drive power if the load should be abnormally light or when the lift is moving while empty. Alternatively, the available lifts which utilize variable weight counterweighting require relatively complex mechanisms for adding and dropping off weights.

Some available vertical lifts, such as the one shown in U.S. Pat. No. 3,661,280, interpose a centrifugal clutch between the lift platform and the counterweights, but such constructions are relatively costly and complex; especially when they also provide mechanisms to mount a portion of the vertical lift for separation from the rest of the lift upon cable or other failure. Other available vertical lifts, such as shown in U.S. Pat. No. 3,606,039 rotate arcuate cam surfaces against a guide rail to thus provide a mechanical brake triggered into operation in response to a slack condition in the lifting cable for the elevator of a stacker crane. But such braking devices are also relatively complex in construction and operation and the cam shaped arcuate braking surfaces require relatively large spring forces to develop braking from what is essentially line contact with the guide rails. Such relatively large spring forces must, in turn, be overcome when the brake is to be inactive.

SUMMARY OF THE INVENTION

It is therefore an object of this invention to provide a new and improved safety brake mechanism for a vertical lift.

It is another object of this invention to provide a new and improved safety brake for the lift carriage of a stacker-retriever for totes.

It is yet still another object of this invention to provide a new and improved brake mechanism for a lift carriage that is raised, lowered, and positioned by power means connected to the lift carriage by a flexible member.

It is yet still a further object of this invention to provide a vertical lift carriage, that is raised, lowered, and maintained in selected positions by a flexible member connected between the lift carriage and a power means, with a brake mechanism that is actuated to its braking condition in response to slack in the flexible member.

This invention involves vertical lifts that include a lifting platform or carriage that is raised, lowered, and held in selected position through the use of a flexible member that connects the lifting platform to a source of motive power, and contemplates: utilizing a pair of brake arms that are held in unactivated condition while there is a predetermined amount of tension applied to the flexible member while raising, lowering and maintaining the position of the lifting platform; and wherein the brake arms are moved into braking engagement with supports that are relatively stationary with respect to the lifting platform in response to slack in the flexible member; and wherein the brake arms coact with the supports, as braking occurs, to enhance and facilitate the braking action.

Other objects, features, and advantages of the invention in its details of construction and arrangement of parts will be seen from the above, from the following description of the preferred embodiment when considered with the drawing and from the appended claims.

DESCRIPTION OF THE PREFERRED EMBODIMENT

For convenience, the invention will be described as applied to a stacker-retriever which is automatically controlled to move along an aisle between opposed racks arranged and spaced to store totes within which parts, components, sub-assemblies, assemblies and the like are disposed. The stacker-retriever includes a lift carriage assembly that is vertically positionable at any one of a predetermined number of different levels, and incorporates a bi-directional shuttle table assembly that can be extended to retrieve a tote, retracted to position the tote for transport to another location, and extended in the opposite direction, if desired, to deposit the tote on a rack for positioning at a workstation, or to deposit the tote at another rack location or in its original location if the tote is being returned from a workstation. A flexible member in the form of a wire cable extends from a power drive to the lift carriage assembly to raise, lower and maintain the vertical position of the lift carriage. It being understood, nevertheless, that without departing from the scope of this invention: that the flexible member can be chain or other suitable flexible member; that the stacker-retriever can be operator as well as automatically controlled; that subject brake mechanism can be utilized on stacker cranes, and vertical lifts other than stacker-retrievers; that the item being stored, delivered and retrieved need not be a tote but can be the article itself or a pallet load of goods; that there may be any number of aisles and cranes; and that the shuttle table need not be bi-directional.

Figure 1:
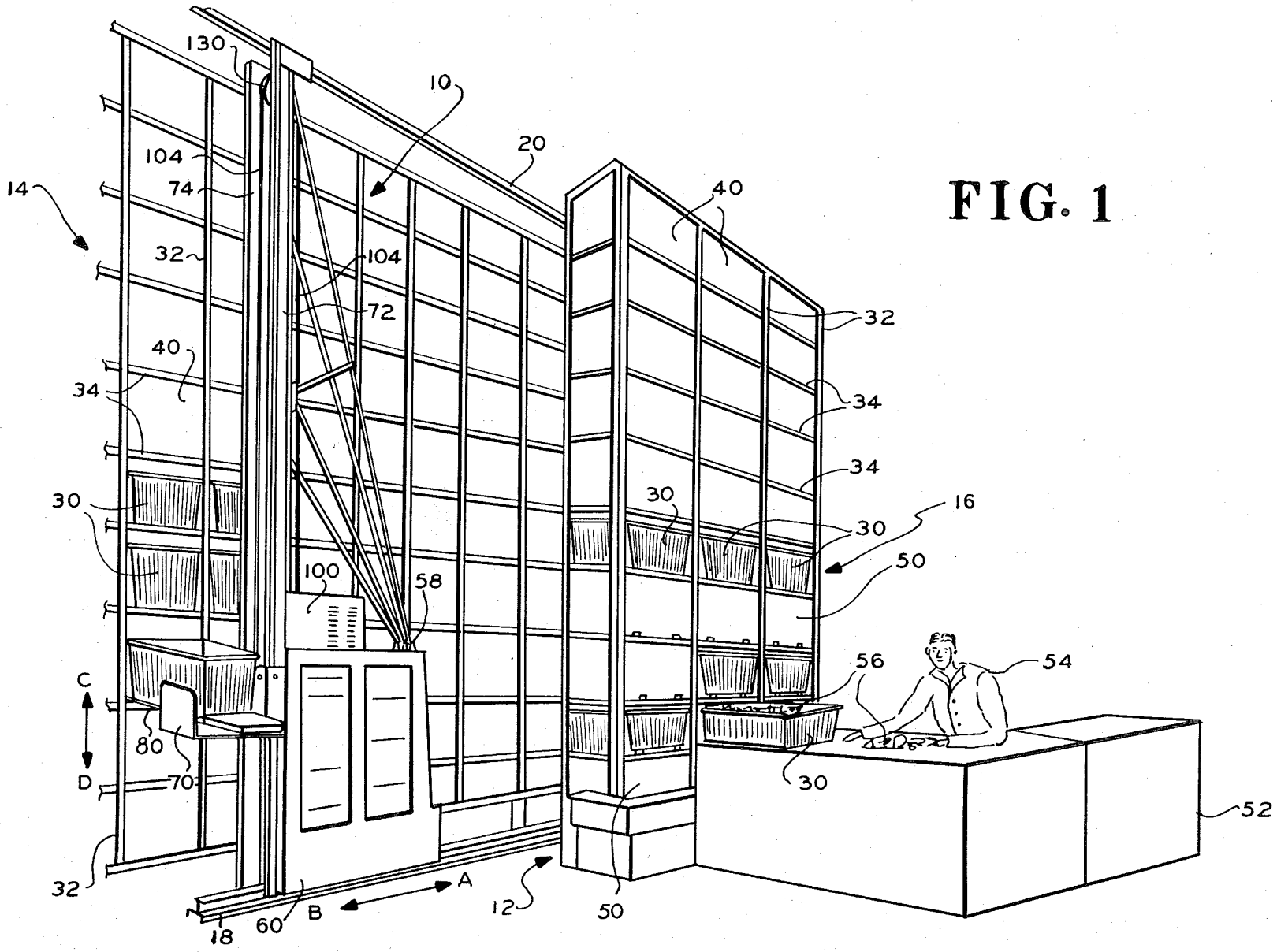
FIG. 1 is a fragmentary perspective view of a warehousing system utilizing a vertical lift in the form of a stacker-retriever which incorporates the instant invention.

With reference to FIG. 1, there is generally shown at 10 a stacker-retriever disposed for movement in the direction of arrows A–B in an aisle 12 between a first rack assembly 14 and a second rack assembly 16. A lower guide rail 18 and an upper guide rail 20 guide such movement of stacker-retriever 10 in aisle 12. Rack assemblies 14, 16, together with stacker-retriever 10 form an automated storage and retrieval system for items (not shown) stored in totes 30; which items can be parts, sub-assemblies, assemblies, tools, jigs, fixtures, and the like.

Rack assemblies 14, 16 are of conventional construction and include vertical members 32 and shelf member 34 with associated support members all assembled together to form the rack assemblies so as to provide a number of storage positions 40 each sized to receive a tote 30. Rack assembly 16, can additionally include a number of access positions 50 that are constructed in a conventional manner with roller-type conveyor rolls (not shown) so that if a tote 30 is deposited in a position 50 it will roll forward near or onto a workstation 52 where an operator 54 will have access to tote 30 to either remove items 56 therefrom or place such items 56 in tote 30. Tote 30 is then returned by stacker-retriever 10 and returned to its original location 40 in either rack assembly 14 or rack assembly 16.

The removal of a tote 30 from a particular storage location 40 and its movement to a particular access location 50 is accomplished by drives, mechanisms and controls 58, of conventional construction, and which are located in cabinet 60 of stacker-retriever 10. During its movement in the direction of arrows A and B along aisle 12 stacker-retriever is guided by lower guide rail 18 and upper guide rail 20; both of which are of conventional construction.

Figure 2:
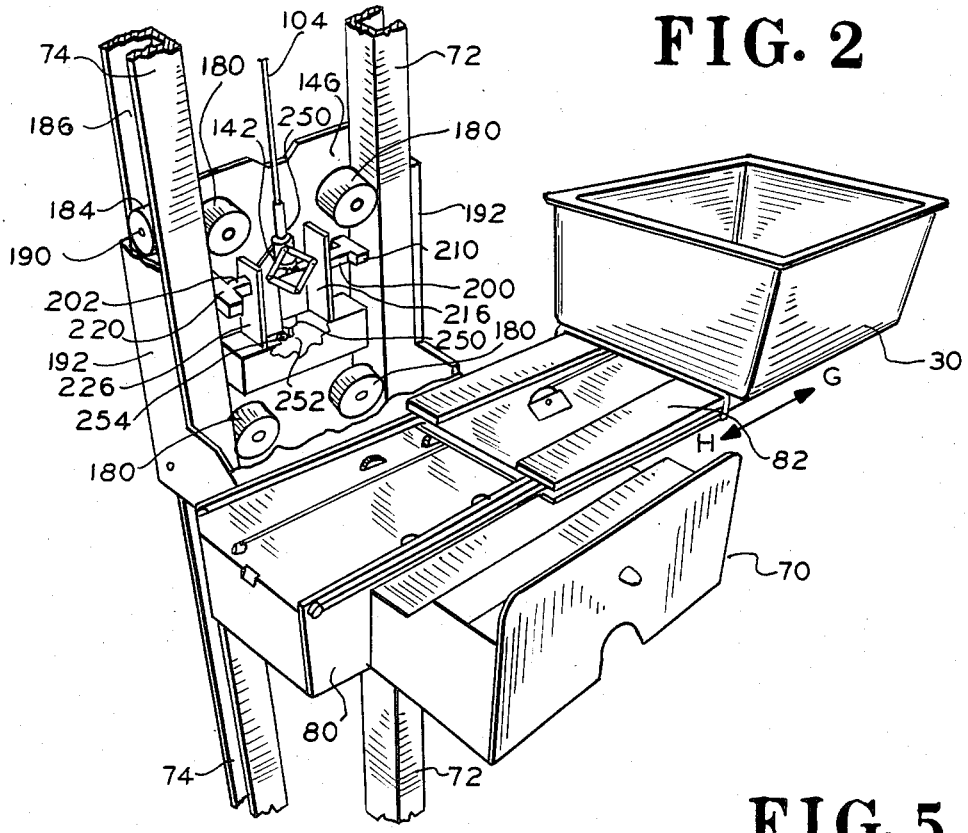
FIG. 2 is an enlarged fragmentary perspective view of the lift carriage assembly and support masts for the stacker-retriever of FIG. 1, cut away in part to better show details of the brake mechanism.

Stacker-retriever 10 carries a lift carriage assembly 70 (FIGS. 1 and 2) disposed for vertical movement (in the direction of arrows C–D, FIG. 1) and guided in such movement by a pair of support masts 72, 74 (FIGS. 1 and 2) of generally "U" shaped channel construction. A shuttle table assembly 80, incorporated into lift carriage assembly 70, includes a shuttle table 82 and approriate drives and controls (not shown) to move shuttle table 82 in the direction of arrows G–H (FIG. 2). Such movement enables shuttle table 82 to extend beneath and pick up a tote 30 from a particular storage location 40, to remove the selected tote 30 from its storage location 40 and to bring tote 30 into a centered position onto lift carriage assembly 70. When so positioned lift carriage assembly 70 may be moved up or down (in the directions of arrow C–D, FIG. 1) as desired; and stacker-retriever 10 may be moved along aisle 12 until lift carriage assembly 70 is aligned with either a different storage location 40 or an access location 50. Such movement of stacker-retriever 10 is under controls 58 which also operate shuttle table assembly 80 to extend shuttle table 82 and deposit tote 30 in a desired location.

Figure 6:
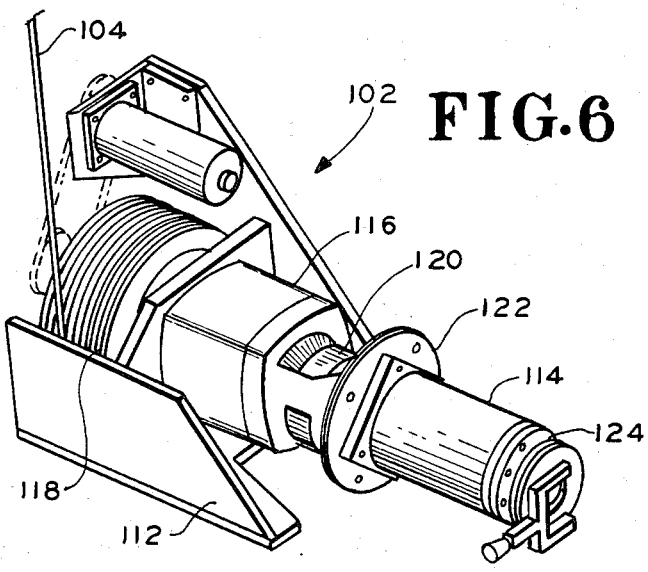
FIG. 6 is a perspective showing of the vertical drive train for the lift carriage assembly of FIG. 2.

The vertical movement of lift carriage assembly 70 is accomplished by a vertical drive 100 which includes a drive train 102 (FIG. 6) disposed on top of or as part of cabinet 60; and which is connected by a wire cable 104 (FIGS. 1 and 2) to lift carriage assembly 70 through safety brake mechanism 110 (FIGS. 2 and 3) as will be hereinafter explained.

Drive train 102 is carried by a support bracket 112 (FIG. 6) secured to cabinet 60 and which secures in place a stepper motor 114, reducer 116, and a cable drum 118 upon which cable 104 is wound and secured. Stepper motor 114, reducer 116 and cable drum 118 are of conventional construction with stepper motor 114 connected to reducer 116 by a flexible coupling 120 through a suitable adapter plate 122. A suitable brake means 124 is conventionally provided to maintain stepper motor 114 in a given position should there be a power failure; and thereby to keep lift carriage assembly 70 in a selected vertical position through cable 104.

Cable 104 extends upwardly from cable drum 118, over a pulley 130 carried between support masts 72, 74, and then downwardly where it is connected by a cable connector 140 to a brake mechanism linkage assembly 142 of safety brake mechanism 110. Linkage assembly is, in turn, connected by a lifting pin 144 to an anchor lug 145 secured to a back plate 146 (FIGS. 2 and 3) of lift carriage assembly 70. Brake mechanism linkage assembly 142 includes a pair of four bar linkages 150, 152 connected to each other in spaced relationship (FIG. 2) by connecting pins 160, 162, 164 and by lifting pin 144.

Thus operation of stepping motor 114 by controls 58, through coupling 120 and reducer 116 will turn cable drum 118 in the appropriate direction to either unwind cable 104 from drum 118 or wind cable 104 onto drum 118. As cable 104 is wound onto drum 118 it will pull upon cable connector 140, connecting pin 160, brake linkages 150, 152 lifting pin 144, anchor lug 145, and back plate 146 to raise lift carriage assembly 70 to a desired level. If cable drum 118 is rotated by stepping motor 114 in a direction to unwind cable 104 from drum 118 the weight of lift carriage assembly 70, through back plate 146, anchor lug 145, pin 144, linkage assemblies 150, 152, pin 160, and connector 140 will pay out cable 104 and permit lift carriage assembly 70 to be lowered to a desired level. The holding torgue of stepping motor 114 maintains lift carriage assembly at the selected level. Lift carriage assembly 70 also carries guide wheels 180 which run on surfaces 182 of support masts 72, 74 and guide wheels 184 which run within openings 186 (FIG. 2) formed by the "U" shaped configuration of support masts 70, 72. Guide wheels 180, 184 guide the movement of lift carriage assembly along support masts 70, 72; with guide wheels 180 being rotatively carried by mounting shafts 188 secured to back plate 146 of lift carriage assembly 70; and with guide wheels 184 carried by mounting shafts 190 carried by side plates 192 of lift carriage assembly 70.

A pair of brake arms 200, 202 are pivotally disposed on connecting pins 162, 164 respectively and between linkage assemblies 150, 152. The forward end of brake arm 200 mounts a brake pad 210 of molded neoprene or other suitable material and is formed with an elongated slot 212 which rides on a pin 214 positioned in an anchor bracket 216. The forward end of brake arm 202 mounts a similar brake pad 220 and is formed with an elongated slot 222 which rides on a pin 224 positioned in an anchor bracket 226. A suitable number of shims 228 may be disposed between brake pads 210, 220 and their respective brake arms 200, 202 to facilitate proper braking action and adjustments. Anchor brackets 216, 226 are suitably secured to back plate 146 of lift carriage assembly 70.

Figure 5:
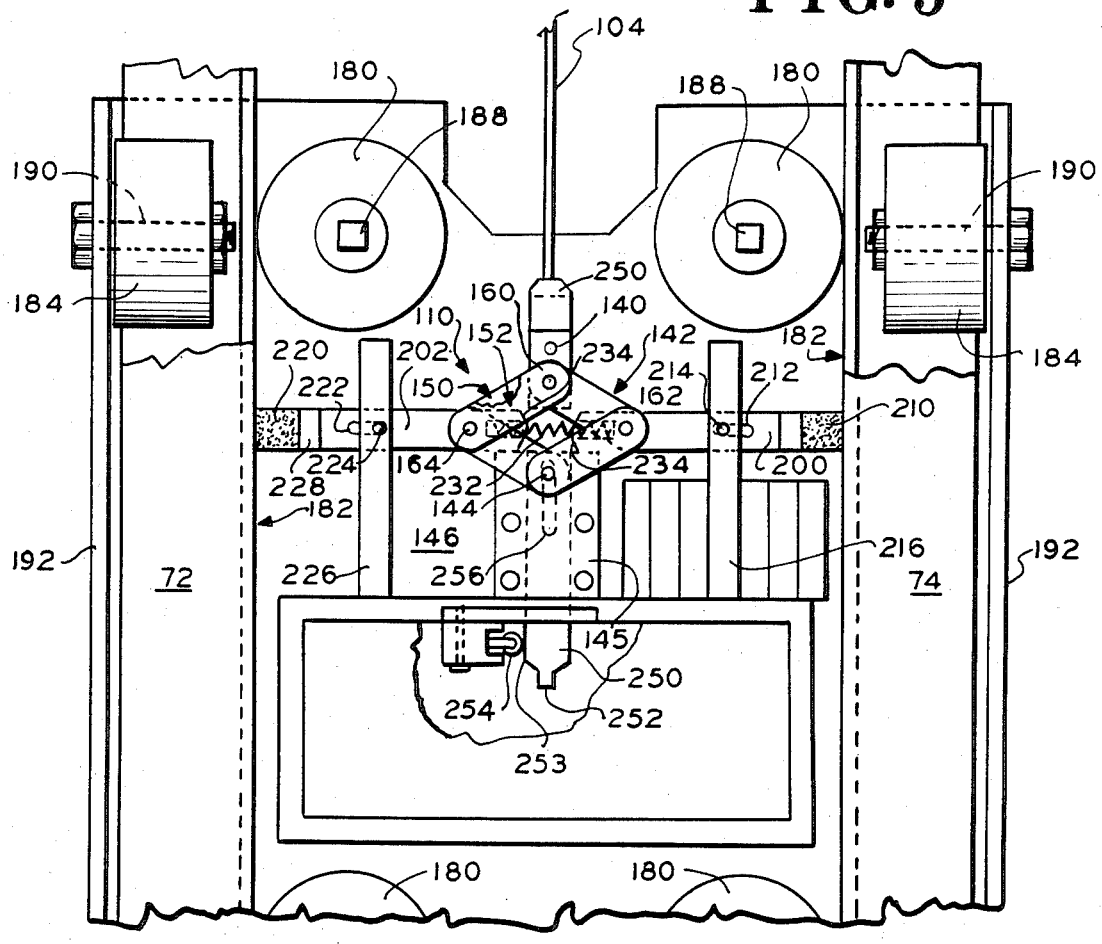
FIG. 5 is a view similar to that of FIG. 3 but showing the brake mechanism in actuated condition.
Figure 3:
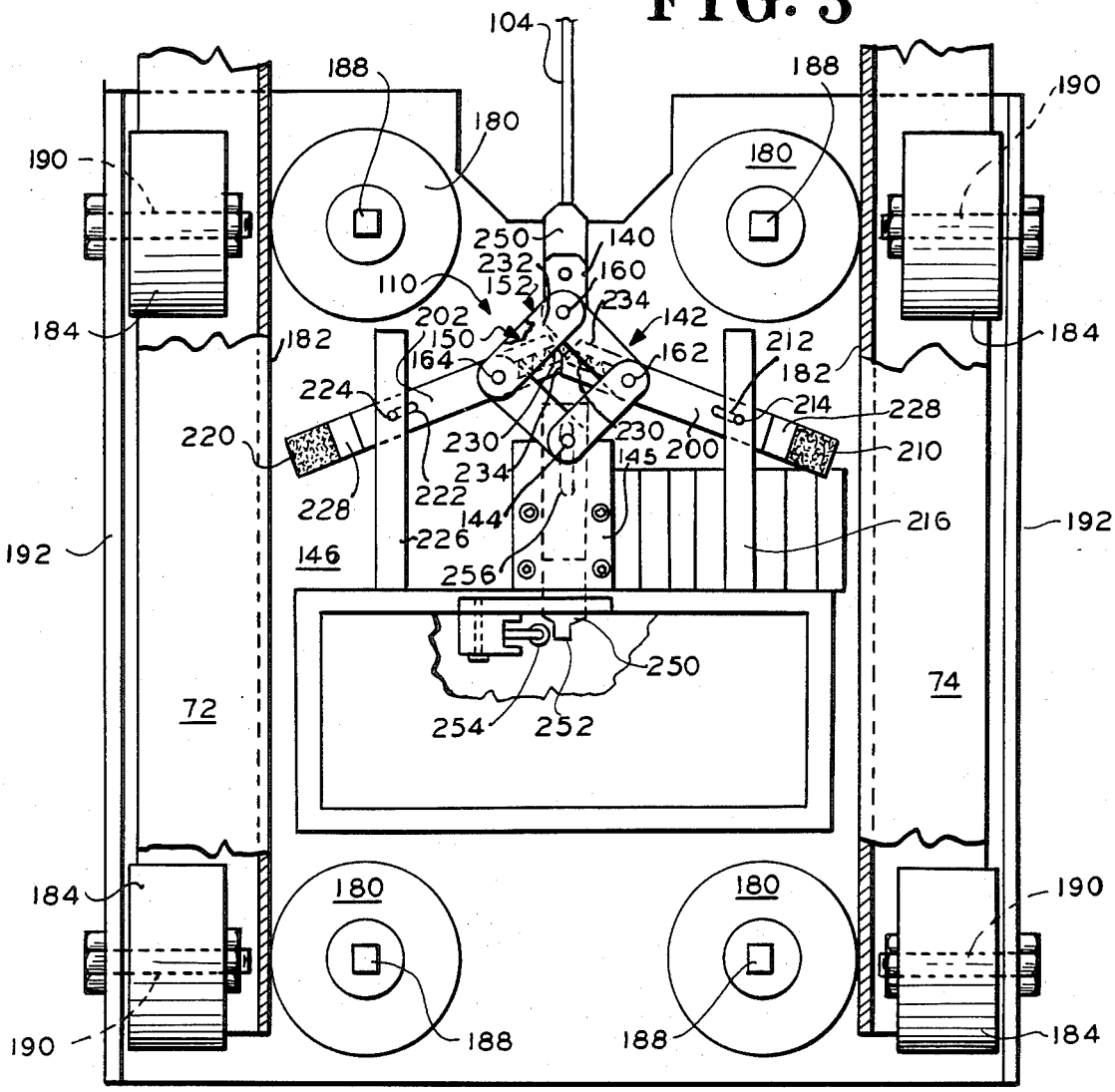
FIG. 3 is a partial rear elevational view of the lift carriage assembly and support masts of FIG. 2 cut away in parts to better show details thereof and showing the brake mechanism in unactuated condition.

The rear ends of brake arms 200, 202 are each formed with an opening 230 within which a brake spring 232 is housed. Brake spring 232 acts to bias brake arms 200, 202 outwardly from an unactuated condition as shown in FIG. 3 to an actuated condition as shown in FIG. 5. However, brake arms 200, 202 are sized and the rear ends thereof are formed with beveled surfaces 234 so that when cable 104 pulls brake linkages 150, 152 to the unactuated condition for brake arms 200, 202 (FIG. 3) beveled surfaces 234 engage each other and brake spring 232 is protected from extraneous and unwanted forces.

A brake switch plunger 250 is also carried by pin 160 and extends downwardly into anchor lug 145. An operating end 252 of plunger 250 extends out from anchor lug 145 and is formed with a cam surface 253 that coacts with a roller actuated switch 254 that is electrically connected to the drive power that when switch 254 is actuated the circuits are opened and power to all drives for stacker-retriever 10 is cut off. An elongated slot 256 is formed in plunger 250 to permit plunger 250 to move with respect to lifting pin 144.

As long as cable 104 pulls up on brake mechanism linkage assembly 142 brake arms 200, 202 will remain in their unactuated condition (FIG. 3) and plunger 250 will maintain brake switch 254 unactuated.

If slack should develop in cable 104, as would occur if cable 104 was severed, or if lift carriage assembly 70 hung up on a protruding object, or if trouble developed in drive train 102, or if similar problems occured, then there would be no upward force on cable 104 to maintain brake mechanism linkage assembly 142 in the brake unactuated condition (FIG. 3) and to counteract the bias of brake spring 232. Brake spring 232, no longer being constrained, urges brake arms 200, 202 away from each other and towards support masts 74, 72 respectively. The connection of brake arms 200, 202 to pins 162 and 164 of linkage mechanism assembly 142 and the disposition of the front ends of brake arms 200 and 202 upon pins 214, 224 respectively results in a combination sliding and pivoting movement of brake arms 200, 202 as they move form their brake unactuated condition (FIG. 3) to their brake actuated condition (FIG. 5).

Figure 4:
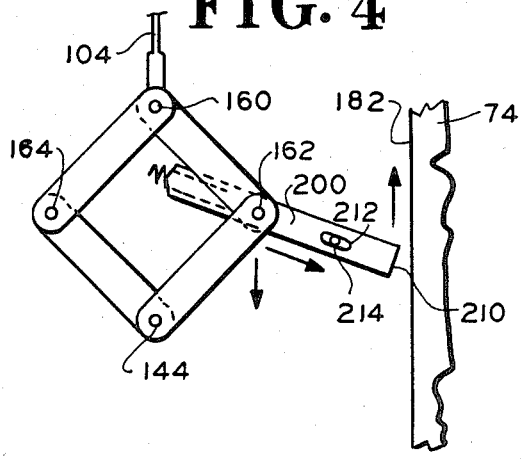
FIG. 4 is a schematic showing of one of the brake arms of the brake mechanism of FIG. 3 illustrating the actions and reactions of the members as the braking action is initiated.

The movement of brake arms 200, 202 towards their actuated condition is assisted and enhanced following initial contact of brake pads 210, 220 with support masts 74, 72 respectively. As best shown in FIG. 4 when brake pad 210 starts to contact support masts 74 a moment will develop about pin 214 that tends to move linkage assembly 142 to its brake actuated condition and connecting pin 162 in a direction to assist the braking movement of brake arm 200. Similar moment forces will develop between brake pad 224 and support masts 72 to move connecting pin 164 in a direction to assist the braking movement of brake arm 202. Such action continues until the safety brake mechanism 110 is fully actuated (FIG. 5) and vertical movement of lift carriage assembly and any load carried thereby is either fully arrested or so slowed down as to bring lift carriage assembly 70 to a safe stop.

The movement of brake arms 200, 202 to their actuated condition, and of linkage assembly 142 to its actuated condition through pin 160 and its connection to plunger 250 moves plunger 250 downwardly (FIG. 3). The roller actuator for switch 254 rides up on cam surface 253 of plunger 250 to actuate switch 254 and cut off power to all drives for stacker-retriever 10.

Correction of the problem that induced actuation of the brake mechanism will restore the action of cable 104 upon brake mechanism linkage assembly 142 and will return the brake mechanism to its unactuated condition.

From the above description, it will thus be seen that there has been provided a new and improved brake mechanism for vertical lifts; which brake mechanism is relatively simple and most efficient, and responds to slack in the cable which positions the vertical lift to release spring urged brake arm into frictional engagement with the support masts for the vertical lift while at the same time operating an electrical switch to cut off all drive power.

It is understood that although I have shown the preferred embodiment of my invention that various modifications may be made in the details thereof without departing from the spirit as comprehended by the following claims.

We claim:

1. Safety brake mechanism for a vertical lift having a lift carriage disposed for movement with respect to a lift carriage support, and which is raised, lowered, and positioned during such movement by a lift carriage drive and a flexible member connecting the lift carriage to the lift carriage drive so that the flexible member is normally under tension and exerts at least a predetermined pull upon the lift carriage while the lift carriage is being raised, lowered, and positioned; said safety brake mechanism, comprising:

(a) brake operating means connecting the lift carriage to the flexible member to transmit to the lift carriage at least the predetermined pull exerted by the lift carriage drive on the flexible member to raise, lower, and position the lift carriage;

(b) said brake operating means including at least four links of substantially equal size connected together proximate their respective ends into a linkage rectangle by pivot pins;

(c) brake means connected to said brake operating means and movable thereby between braking position in engagement with the lift carriage support and a brake unactuated position removed therefrom;

(d) said brake means including a first brake arm and a second brake arm;

(e) a first one of said pivot pins connecting said brake operating means to said lift carriage, a second one of said pivot pins connecting said brake operating means to said flexible member, a third one of said pivot pins connecting said brake operating means to said first brake arm and the fourth one of said pivot pins connecting said brake operating means to said second brake arm;

(f) a brake spring urging said first brake arm and said second brake arm towards said braking position in engagement with the lift carriage support;

(g) said brake means being moved to said brake unactuated position by said brake operating means and against the urging of said brake spring, by at least the predetermined pull exerted upon the brake operating means when connecting the flexible member to the lift carriage;

(h) said brake spring moving said brake operating means into a brake operating condition and said brake spring and brake operating means moving said brake means to said braking position when less than the predetermined pull is exerted by the flexible member upon the brake operating means; and (i) mounting means mounting said first brake arm and said second brake arm each for combined pivoting and sliding movement towards and away from the lift carriage support and for coaction therewith, and in such a way that said coaction, between said respective brake arm and the lift carriage support, through said brake operating means facilitates the operation of said brake operating means into said brake operating condition and thereby the coaction between said brake means and the lift carriage support to increase braking forces of one upon the other.

2. The safety brake mechanism of claim 1, wherein said mounting means coact to assist the movement of said brake means into engagement with the lift carriage support following initial engagement of said brake means with the lift carriage support under urging of said brake spring.

3. The safety brake mechanism of claim 2, wherein power means are provided to power the lift carriage drive and power cut-off means are connected to said power means to cut-off power therefrom to the lift carriage drive and power cut-off operating means are connected to said brake operating means to be operated thereby to cut-off power to the lift carriage drive upon movement of said brake means towards said braking position.

4. The safety brake mechanism of claim 2, wherein each brake arm is mounted by a pivot, spaced from said pivot pin connecting the brake arm to said operating means and disposed within a slot, to provide said combined pivoting and sliding movement such that following said initial engagement moments are developed in each of said brake arms about its respective pivot which facilitates movement of said brake operating means into said brake operating condition and of said brake arms into said brake operating condition and of said brake arms into said braking position.

5. The safety brake of claim 4, wherein said mounting means includes a bracket within which said slot is formed.

6. The safety brake mechanism of claim 5, wherein said first brake arm and said second brake arm are disposed in an aligned relationship each with a back end disposed in spaced relationship one with the other and each such back end includes spring receiving means for said brake spring.

7. The safety brake mechanism of claim 6, wherein said back end of each of said brake arms are formed into a predetermined beveled configuration and said brake arms are further formed so that in the unactuated position thereof said back ends engage each other.

8. The safety brake mechanism of claim 7, wherein each brake arm includes a friction pad affixed to a front end thereof and positioned thereon for engagement with the lift carriage support when its brake arm is in engagement therewith.

9. The safety brake mechanism of claim 8, including shim means disposed between each of said friction pads and its respective brake arm.

10. The safety brake mechanism of claim 9, wherein said brake operating means includes a pair of linkage rectangles arranged in aligned and spaced and parallel relationship one with the other and said pivot pins extend between said linkage rectangles.

11. A stacker-retriever comprising:

(a) a lift carriage;

(b) shuttle means carried by said lift carriage;

(c) a pair of spaced support masts supporting said lift carriage to be raised, lowered, and positioned with respect to said support masts;

(d) a lift carriage drive;

(e) a flexible cable connected to said lift carriage drive and to said lift carriage so that said flexible cable is normally under tension and exerts at least a predetermined pull upon the lift carriage while the lift carriage is being so raised, lowered, and positioned.

(f) brake operating means connecting said lift carriage to said flexible cable to transmit to said lift carriage at least the predetermined pull exerted by said lift carriage drive on said flexible cable to raise, lower, and position said lift carriage;

(g) said brake operating means including at least four links of substantially equal size connected together proximate their respective ends into a linkage rectangle by pivot pins;

(h) brake means connected to said brake operating means and movable thereby between a braking position in engagement with said support masts and a brake unactuated position removed therefrom;

(i) said brake means including a first brake arm and a second brake arm;

(j) a first one of said pivot pins connecting said brake operating means of said lift carriage, a second one of said pivot pins connecting said brake operating means to said flexible cable, a third one of said pivot pins connecting said brake operating means to said first brake arm and the fourth one of said pivot pins connecting said brake operating means to said second brake arm;

(k) a brake spring urging said first brake arm and said second brake arms towards said braking position in engagement with said support masts;

(l) said brake means being moved to said brake unactuated position by said brake operating means and against the urging of said brake spring, by at least the predetermined pull exerted upon said brake operating means when connecting said flexible cable to said lift carriage;

(m) said brake spring moving said brake operating means into a brake operating condition and said brake spring and brake operating means moving said brake means to said braking position when less than said predetermined pull is exerted by said flexible cable upon said brake operating means; and (n) mounting means mounting said first brake arm and said second brake arm each for combined pivoting and sliding movement towards and away from said support masts and for coaction therewith, and in such a way that said coaction, between said respective brake arms and said support masts, through said brake operating means, facilitates the operation of said brake operating means into said brake operating condition and thereby the coaction between said brake means and said support masts to increase braking forces of one upon the other.

12. The stacker-retriever of claim 11, wherein said mounting means coact to assist the movement of said brake means into engagement with said support masts following initial engagement of said brake means with said support masts under urging of said spring means.

13. The stacker-retriever of claim 12, wherein power means are provided to power said lift carriage drive and power cut-off means are connected to said power means to cut-off power therefrom to said lift carriage drive and power cut-off operating means are connected to said brake operating means to be operated thereby to cut-off power to said lift carriage drive upon movement of said brake means towards said braking position.

14. The stacker-retriever of claim 13, wherein said power means provide electrical power to an electrically operated lift carriage drive and said power cut-off means is an electrical switch.

15. The stacker-retriever of claim 12, wherein each brake arm is mounted by a pivot, spaced from said pivot pin connecting the brake arm to said operating means and disposed within a slot, to provide said combined pivoting and sliding movement such that following said initial engagement moments are developed in each of said brake arms about its respective pivot which facilitates movement of said brake operating means into said brake operating condition and of said brake arms into said braking position.

16. The stacker-retriever of claim 15, wherein said first brake arm and said second brake arm are disposed in an aligned relationship each with a back end disposed in spaced relationship one with the other and each such back end includes spring receiving means for said brake spring.

17. The stacker-retriever of claim 16, wherein said back end of each of said brake arms are formed into a predetermined beveled configuration and said brake arms are further formed so that in the unactuated position thereof said back ends engage each other.

18. The stacker-retriever of claim 17, wherein each brake arm includes a friction pad affixed to a front end thereof and positioned thereon for engagement with one of said support masts when its brake arm is in engagement therewith.

19. The stacker-retriever of claim 18, including shim means disposed between each of said friction pads and its respective brake arm.

20. The stacker-retriever of claim 19, wherein said brake operating means includes a pair of linkage rectangles arranged in aligned and spaced and parallel relationship one with the other and said pivot pins extend between said linkage rectangles.

21. The safety brake of claim 15, wherein said mounting means includes a bracket within which said slot is formed.

* * * * *